US006991343B2

(12) United States Patent
Langley et al.

(10) Patent No.: US 6,991,343 B2
(45) Date of Patent: Jan. 31, 2006

(54) ILLUMINATED CHEST PROTECTION DEVICE

(76) Inventors: John K. Langley, 260 W. Oakland Dr., Saint Rose, LA (US) 70087; Michelle J. Langley, 260 W. Oakland Dr., Saint Rose, LA (US) 70087

( * ) Notice: Subject to any disclaimer, the term of this patent is extended or adjusted under 35 U.S.C. 154(b) by 178 days.

(21) Appl. No.: 10/678,803

(22) Filed: Oct. 6, 2003

(65) Prior Publication Data

US 2005/0073834 A1 Apr. 7, 2005

(51) Int. Cl.
*A41D 13/01* (2006.01)

(52) U.S. Cl. ..... 362/108; 2/462; 2/463

(58) Field of Classification Search ..... 362/108, 362/570, 84, 252, 551, 555, 559, 34, 103, 362/157, 227, 249, 812; 2/462, 463, 455, 2/456, 102, 913; 359/518, 519, 515, 516; D29/100, 101.1, 101.3, 104
See application file for complete search history.

(56) References Cited

U.S. PATENT DOCUMENTS

| | | | | |
|---|---|---|---|---|
| 4,328,533 | A * | 5/1982 | Paredes | 362/108 |
| 5,226,192 | A * | 7/1993 | Jones et al. | 2/461 |
| 5,469,342 | A * | 11/1995 | Chien | 362/103 |
| 5,479,659 | A * | 1/1996 | Bachner, Jr. | 2/2.5 |
| 5,530,966 | A * | 7/1996 | West | 2/463 |
| 5,570,945 | A * | 11/1996 | Chien et al. | 362/103 |
| 5,690,411 | A * | 11/1997 | Jackman | 362/103 |
| 5,978,961 | A * | 11/1999 | Barker | 2/463 |
| 6,095,657 | A * | 8/2000 | Kent | 362/108 |
| 6,698,903 | B2 * | 3/2004 | Hall | 359/516 |

* cited by examiner

*Primary Examiner*—Thomas M. Sember
*Assistant Examiner*—Ismael Negron

(57) ABSTRACT

The illuminated chest protection device includes a chest protector assembly including a front upper torso plate member, a back upper torso plate member, shoulder protection members being attached to the front upper torso plate, and connectors interconnecting the shoulder protection members to the back upper torso plate member; and also includes light-emitting elements being disposed in the front and back upper torso plate members; and further includes a light control unit being attached to the chest protector assembly and being connected to the light-emitting elements.

6 Claims, 4 Drawing Sheets

ILLUMINATED CHEST PROTECTION DEVICE

BACKGROUND OF THE INVENTION

1. Field of the Invention

The present invention relates to illuminated chest protectors and more particularly pertains to a new illuminated chest protection device for making motor-cross riders, in particular, more visible especially at night.

2. Description of the Prior Art

The use of illuminated chest protectors is known in the prior art. More specifically, illuminated chest protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,458,097; U.S. Pat. No. 5,239,951; U.S. Pat. No. 5,746,167; U.S. Pat. No. 6,032,630; U.S. Pat. No. 5,931,125; and U.S. Pat. No. Des. 440,837.

While these devices fulfill their respective, particular objectives and requirements, the aforementioned patents do not disclose a new illuminated chest protection device. The prior art includes wearing apparel which have luminescent indicia displayed thereupon.

SUMMARY OF THE INVENTION

The general purpose of the present invention, which will be described subsequently in greater detail, is to provide a new illuminated chest protection device which has many of the advantages of the illuminated chest protectors mentioned heretofore and many novel features that result in a new illuminated chest protection device which is not anticipated, rendered obvious, suggested, or even implied by any of the prior art illuminated chest protectors, either alone or in any combination thereof. The present invention includes a chest protector assembly including a front upper torso plate member, a back upper torso plate member, shoulder supported members being attached to the front upper torso plate, and connectors interconnecting the shoulder supported members to the back upper torso plate member; and also includes light-emitting elements being disposed in the front and back upper torso plate members; and further includes a light control unit being attached to the chest protector assembly and being connected to the light-emitting elements. None of the prior art includes the combination of the elements of the present invention.

There has thus been outlined, rather broadly, the more important features of the illuminated chest protection device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new illuminated chest protection device which has many of the advantages of the illuminated chest protectors mentioned heretofore and many novel features that result in a new illuminated chest protection device which is not anticipated, rendered obvious, suggested, or even implied by any of the prior art illuminated chest protectors, either alone or in any combination thereof.

Still another object of the present invention is to provide a new illuminated chest protection device for making motor-cross riders, in particular, more visible especially at night.

Still yet another object of the present invention is to provide a new illuminated chest protection device that is easy and convenient to put on and wear.

Even still another object of the present invention is to provide a new illuminated chest protection device that not only protects the motorcyclists but also make them much more visible to other motorcyclists.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
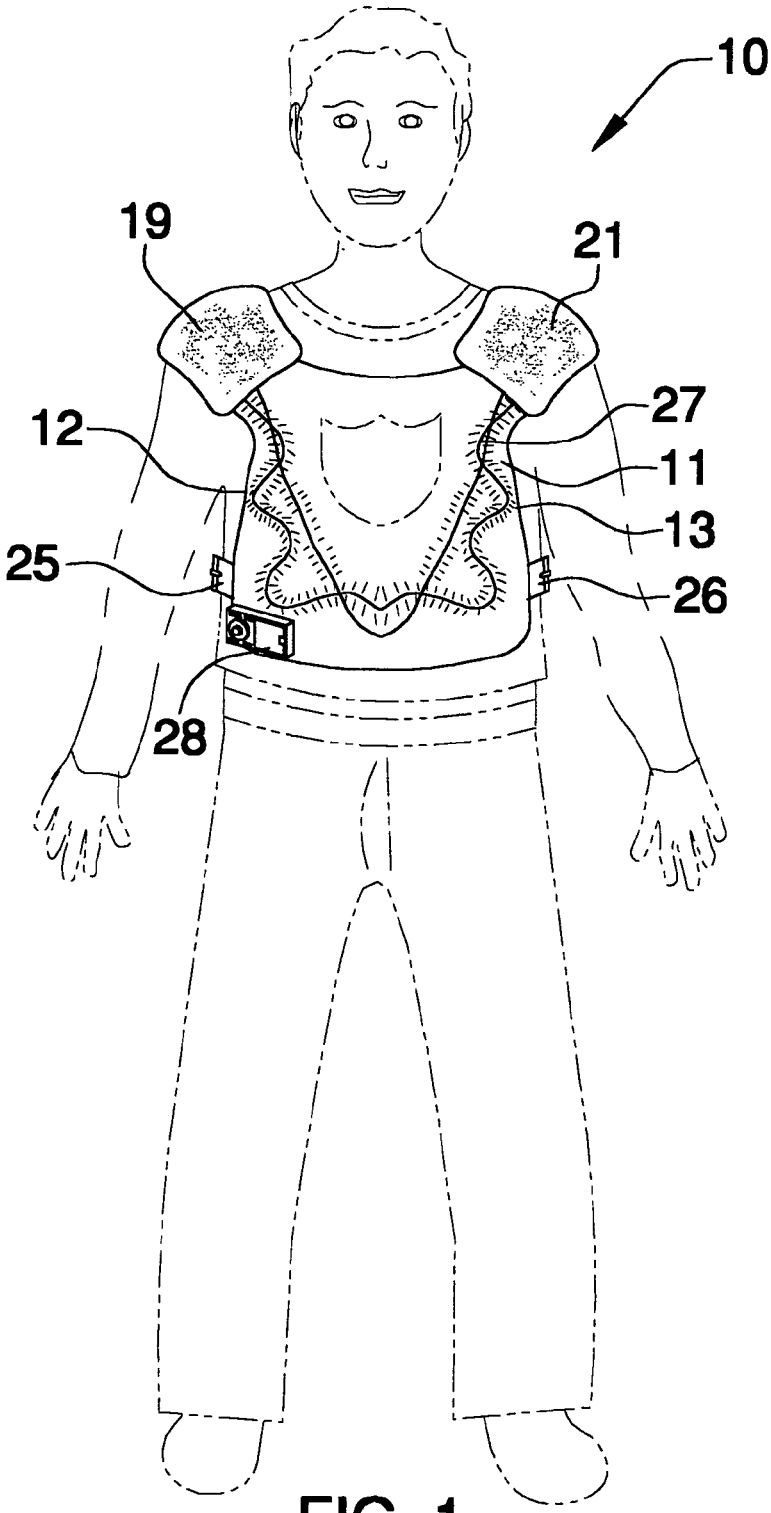
FIG. 1 is a front elevational view of a new illuminated chest protection device according to the present invention.
Figure 2:
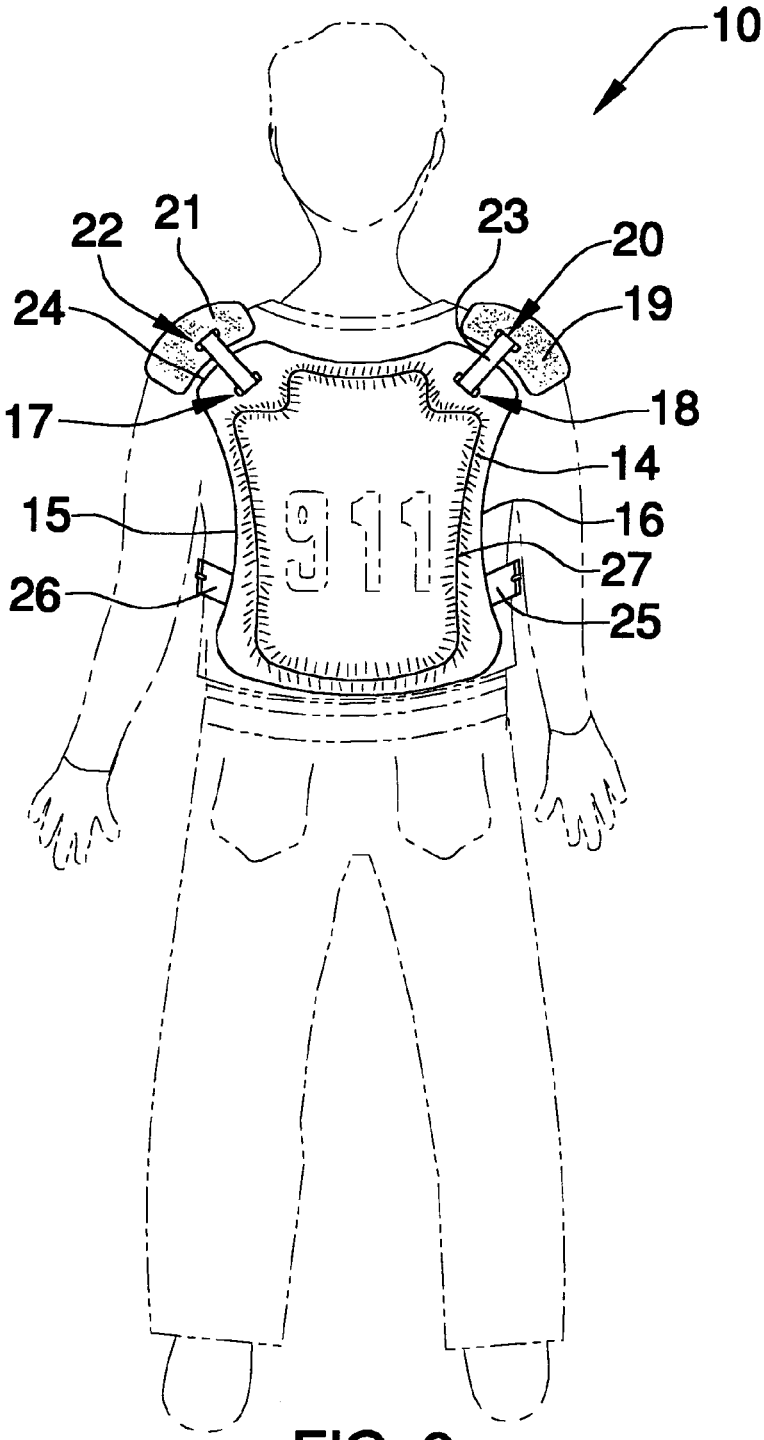
FIG. 2 is a back elevational view of the present invention.
Figure 3:
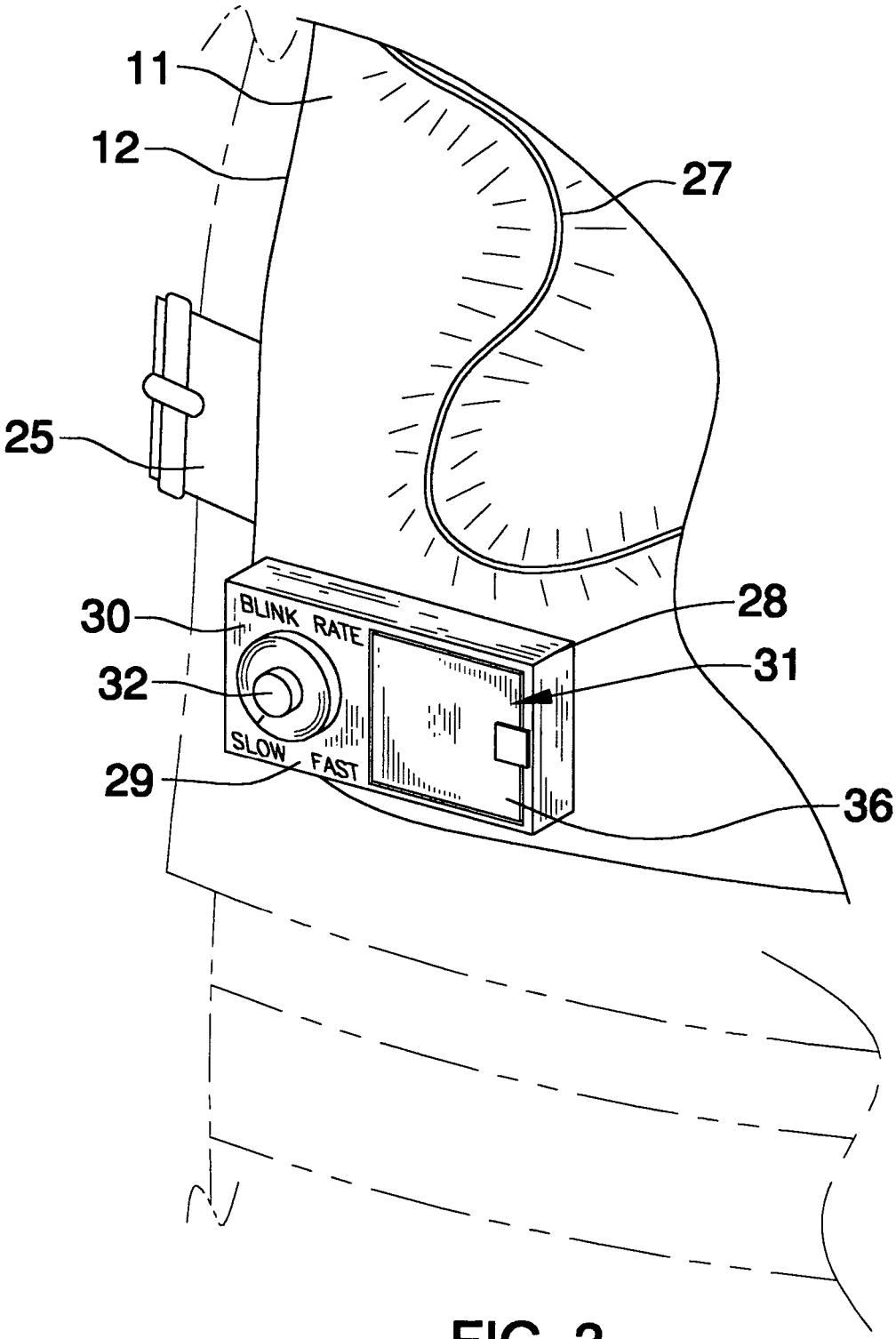
FIG. 3 is a partial perspective view of the present invention.
Figure 4:
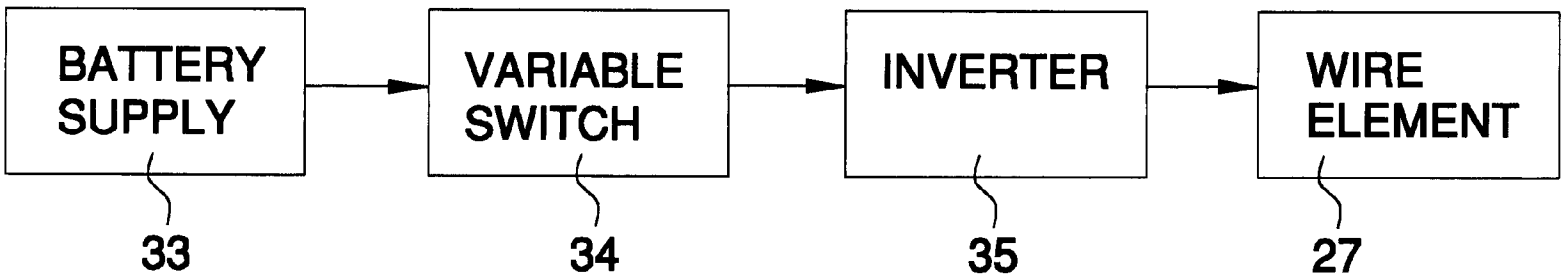
FIG. 4 is a schematic view of the present invention.

With reference now to the drawings, and in particular to FIGS. 1 through 4 thereof, a new illuminated chest protection device embodying the principles and concepts of the present invention and generally designated by the reference numeral 10 will be described.

As best illustrated in FIGS. 1 through 4, the illuminated chest protection device 10 generally comprises a chest protector assembly including a front upper torso plate member 11, a back upper torso plate member 14, shoulder protection members 19,21 being conventionally attached to the front upper torso plate 11, and connectors 23,24 interconnecting the shoulder protection members 19,21 to the back upper torso plate member 14. The chest protector assembly also includes strap members 25,26 conventionally interconnecting the front and back upper torso plate members 11,14. The front upper torso plate member 11 is adapted to cover a user's upper torso from a user's waist up to a user's neck, and has contoured longitudinal side edges 12,13 which bow inwardly of the front upper torso plate member 11. The back upper torso plate member 14 is adapted to cover a user's upper torso from a user's waist up to a user's neck, and has contoured longitudinal side edges 15,16 which bow inwardly of the back upper torso plate member 14, and also has openings being 17,18 being disposed in upper corners thereof. Each of the shoulder protection members 19,21 is a longitudinally-curved plate and has an aperture 20,22 being disposed therethrough near a back edge thereof. The connectors 23,24 are flexible bands being disposed through the openings 17,18 of the back upper torso plate member 14 and the apertures 20,22 of the shoulder protection members 19,21. Each of the strap members 25,26 has ends which are securely and conventionally attached and sewn to respective longitudinal side edges 12,13, 15,16 of the front and back upper torso plate members 11,14.

Light-emitting elements 27 are conventionally disposed in the front and back upper torso plate members 11,14. The light-emitting elements 27 include phosphorous-coated wires which are conventionally disposed throughout and upon the front and back upper torso plate members 11,14 and are arranged to display messages which blink on and off. AS a second embodiment, the light-emitting elements include electro-luminescent film which are conventionally disposed throughout and the front and back upper torso plate members 11,14 and which are arranged to display messages.

A light control unit 28 is conventionally attached to the chest protector assembly and is conventionally connected to the light-emitting elements 27. The light control unit 28 includes a housing 29 having a front wall 30 and a battery compartment opening 31 being disposed through the front wall 30; and also includes a dial 32 being rotatably and conventionally disposed upon the front wall 30 of the housing 29; and further includes a battery 33 being removably disposed in the housing 29; and also includes a variable switch member 34 being conventionally connected to the battery 33 and to the dial 32 for controlling a rate at which the light-emitting members 27 blink; and further includes an inverter 35 being conventionally connected to the variable switch member 34 and to the light-emitting elements 27 for the energizing of the light-emitting elements 27; and also includes a cover 36 being removably and conventionally disposed over the battery compartment opening 31.

In use, the user puts the illuminated chest protector assembly upon one's upper torso, and energizes the light-emitting elements 27 user the control unit 28 which also can be adjusted to control the frequency at which the light-emitting elements 27 blink off and on. The light-emitting elements 27 are arranged to spell out the wearer's name and number so that other motor-cross riders can identify the person at night.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the illuminated chest protection device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An illuminated chest protection device comprising:

a chest protector assembly including a front upper torso plate member, a back upper torso plate member, shoulder protection members being attached to said front upper torso plate, and connectors interconnecting said shoulder protection members to said back upper torso plate member, said chest protector assembly also including strap members interconnecting said front and back upper torso plate members, said front upper torso plate member being adapted to cover a user's upper torso from a user's waist up to a user's neck, and having contoured longitudinal side edges which bow inwardly of said front upper torso plate member, said back upper torso plate member being adapted to cover a user's upper torso from a user's waist up to a user's neck, and having contoured longitudinal side edges which bow inwardly of said back upper torso plate member, and also has openings being disposed in upper corners thereof, each of said shoulder protection members being a longitudinally-curved plate and has an aperture being disposed therethrough near a back edge thereof;

light-emitting elements being disposed in said front and back upper torso plate members; and a light control unit being attached to said chest protector assembly and being connected to said light-emitting elements.

2. The illuminated chest protection device as described in claim 1, wherein said connectors are flexible bands being disposed through said openings of said back upper torso plate member and said apertures of said shoulder protection members.

3. The illuminated chest protection device as described in claim 2, wherein each of said strap members has ends which are securely attached to respective said longitudinal side edges of said front and back upper torso plate members.

4. The illuminated chest protection device as described in claim 3, wherein said light-emitting elements are phosphorous-coated wires which are disposed throughout and upon said front and back upper torso plate members and are arranged to display messages which blink on and off.

5. The illuminated chest protection device as described in claim 3, wherein said light-emitting elements are electro-luminescent film which are disposed throughout and upon said front and back upper torso plate members and are arranged to display messages.

6. The illuminated chest protection device as described in claim 3, wherein said light control unit includes a housing having a front wall and a battery compartment opening being disposed through said front wall; and also includes a dial being rotatably disposed upon said front wall of said housing; and further includes a battery being removably disposed in said housing; and also includes a variable switch member being connected to said battery and to said dial for controlling a rate at which said light-emitting members blink; and further includes an inverter being connected to said variable switch member and to said light-emitting elements for the energizing of said light-emitting elements; and also includes a cover being removably disposed over said battery compartment opening.

* * * * *